US009074313B2

(12) United States Patent
Kim et al.

(10) Patent No.: US 9,074,313 B2
(45) Date of Patent: Jul. 7, 2015

(54) LAUNDRY TREATING APPARATUS

(75) Inventors: Sung Min Kim, Seoul (KR); Don Won Kim, Seoul (KR); Sog Kie Hong, Seoul (KR); Hea Kyung Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1037 days.

(21) Appl. No.: 13/133,603

(22) PCT Filed: Dec. 9, 2009

(86) PCT No.: PCT/KR2009/007352

§ 371 (c)(1),
(2), (4) Date: Aug. 22, 2011

(87) PCT Pub. No.: WO2010/068032

PCT Pub. Date: Jun. 17, 2010

(65) Prior Publication Data

US 2011/0296703 A1 Dec. 8, 2011

(30) Foreign Application Priority Data

Dec. 9, 2008 (KR) ..... 10-2008-0124855
Dec. 9, 2009 (KR) ..... 10-2009-0121763

(51) Int. Cl.

| | |
|---|---|
| ***F26B 5/14*** | (2006.01) |
| ***F26B 9/00*** | (2006.01) |
| ***D06F 58/10*** | (2006.01) |
| ***D06F 73/02*** | (2006.01) |

(52) U.S. Cl.
CPC ..... *D06F 58/10* (2013.01); *D06F 73/02* (2013.01)

(58) Field of Classification Search
CPC ..... D06F 58/10; D06F 73/02
USPC ..... 34/401, 164, 90, 89, 218; 74/10.45, 74/10.6, 10.9, 25, 826, 27, 36, 79, 105, 76, 74/570.2, 33
See application file for complete search history.

(56) References Cited

U.S. PATENT DOCUMENTS

| | | | | |
|---|---|---|---|---|
| 1,602,315 | A | 10/1926 | Wood | |
| 3,114,919 | A | 12/1963 | Kenreich | |
| 3,256,617 | A | 6/1966 | Konstandt | |
| 3,739,496 | A * | 6/1973 | Buckley et al. | 34/210 |
| 3,861,179 | A * | 1/1975 | Orchard | 68/6 |
| 4,304,053 | A | 12/1981 | Kellerhals et al. | |
| 4,475,726 | A * | 10/1984 | Smith | 269/41 |
| 5,059,753 | A * | 10/1991 | Hamm | 218/84 |
| 5,238,116 | A * | 8/1993 | Santicchi | 209/3.3 |
| 5,600,975 | A | 2/1997 | McClain et al. | |
| 6,189,346 | B1 | 2/2001 | Chen et al. | |
| 6,510,785 | B1 * | 1/2003 | Margolin | 99/495 |

(Continued)

FOREIGN PATENT DOCUMENTS

| | | |
|---|---|---|
| CN | 1773002 A | 5/2006 |
| CN | 1966835 A | 5/2007 |

(Continued)

*Primary Examiner* — Kenneth Rinehart
*Assistant Examiner* — John McCormack
(74) *Attorney, Agent, or Firm* — McKenna Long & Aldridge LLP

(57) ABSTRACT

A laundry treating apparatus is disclosed. The laundry treating apparatus includes a treating chamber to accommodate laundry, a heating part to supply at least one of hot air and steam to the treating chamber, a hanger bar arranged in the treating chamber, a driving part provided on an outside of the treating chamber to generate a rotational force, a power transmitting part transmitting the rotational force of the driving part, and a power converting part converting the rotational force transmitted by the power transmitting part to reciprocate the hanger bar.

23 Claims, 9 Drawing Sheets

(56) References Cited

U.S. PATENT DOCUMENTS

| | | | | |
|---|---|---|---|---|
| 7,103,996 | B2 | 9/2006 | Hapke | |
| 7,137,211 | B2 | 11/2006 | Johnson et al. | |
| 2005/0197224 | A1* | 9/2005 | Sasaki et al. | 474/116 |
| 2008/0028562 | A1* | 2/2008 | Lin | 15/250.003 |
| 2009/0255091 | A1* | 10/2009 | Jung et al. | 16/308 |
| 2010/0146805 | A1 | 6/2010 | Kim et al. | |

FOREIGN PATENT DOCUMENTS

| | | | | |
|---|---|---|---|---|
| FR | 2802032 | A1 | * | 6/2001 |
| GB | 1347800 | | | 2/1974 |
| GB | 1414041 | A | | 11/1975 |
| JP | H5-39498 | | | 5/1993 |
| JP | 6-339598 | | | 12/1994 |
| JP | 2000-037598 | | | 2/2000 |
| JP | 2001137599 | A | | 5/2001 |
| JP | 2006-130157 | | | 5/2006 |
| JP | 2006130157 | A | * | 5/2006 |
| KR | 2002/0096676 | A | | 12/2002 |
| KR | 10-0524400 | B1 | | 10/2005 |
| KR | 10-2008-0098860 | | | 11/2008 |
| ZA | 9604906 | A | * | 11/1997 |

* cited by examiner

LAUNDRY TREATING APPARATUS

This application is a National Stage Entry of International Application No. PCT/KR2009/007352, filed Dec. 9, 2009, and claims the benefit of Korean Patent Application Nos. 10-2008-0124855, filed on Dec. 9, 2008, and 10-2009-0121763, filed on Dec. 9, 2009, all of the applications are hereby incorporated by reference for all purposes as if fully set forth herein.

TECHNICAL FIELD

The present invention relates to a laundry treating apparatus, more particularly, to a laundry treating apparatus that is able to dry, deodorize, wrinkle-remove and sterilize clothes, cloth items and beddings (hereinafter, laundry).

BACKGROUND ART

Cloth treating apparatuses typically include washers for washing laundry, dryers for drying wet laundry, and refreshers for removing unpleasant smell or wrinkles of laundry.

Recently, a laundry treating apparatus functioning as a single appliance capable of performing the washing, drying, deodorizing and wrinkle-removing has been under development.

DISCLOSURE OF INVENTION

Technical Problem

However, such a recent laundry treating apparatus uses a drum receiving laundry and a driving part rotating the drum. Because of that, the laundry treating apparatus has an insufficient ability to remove wrinkles or unpleasant smell of the laundry.

That is, it is common in the conventional laundry treating apparatus to perform the deodorizing or wrinkle-removing during the rotation of the drum and the laundry introduced into the drum is not spread straight but crumpled such that the conventional laundry machine may have limitation of the deodorizing or wrinkle-removing.

Technical Solution

To solve the problems, an object of the present invention is to provide a laundry treating apparatus including a driving part provided an outside of a treating chamber only to improve space utility of the treating chamber.

Another object of the present invention is to provide a laundry treating apparatus that is able to minimize space required in installation by reducing the length of the apparatus in a width direction.

To achieve these objects and other advantages and in accordance with the purpose of the invention, as embodied and broadly described herein, a laundry treating apparatus includes a treating chamber to accommodate laundry, a heating part to supply at least one of hot air and steam to the treating chamber, a hanger bar arranged in the treating chamber, a driving part provided on an outside of the treating chamber to generate a rotational force, a power transmitting part transmitting the rotational force of the driving part, and a power converting part converting the rotational force transmitted by the power transmitting part to reciprocate the hanger bar.

Advantageous Effects

The present invention has following advantageous effects.

According to the laundry treating apparatus, the driving part is provided on an outside of a treating chamber. As a result, space utility of the treating chamber may be improved.

Furthermore, according to the laundry treating apparatus, the length of the apparatus in a width direction is reduced. As a result, space required in installation may be minimized.

A still further, according to the laundry treating apparatus, the treating chamber is enlarged with a large capacity. As a result, the amount of the laundry treatable in the treating chamber may be increased.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

As follows, an exemplary embodiment of the present invention will be described in reference to the accompanying drawings.

Reference will now be made in detail to the specific embodiments of the present invention, examples of which are illustrated in the accompanying drawings.

Wherever possible, the same reference numbers will be used throughout the drawings to refer to the same or like parts.

As follows, the present invention will be described in reference to the drawings to explain a laundry treating apparatus.

Figure 1:
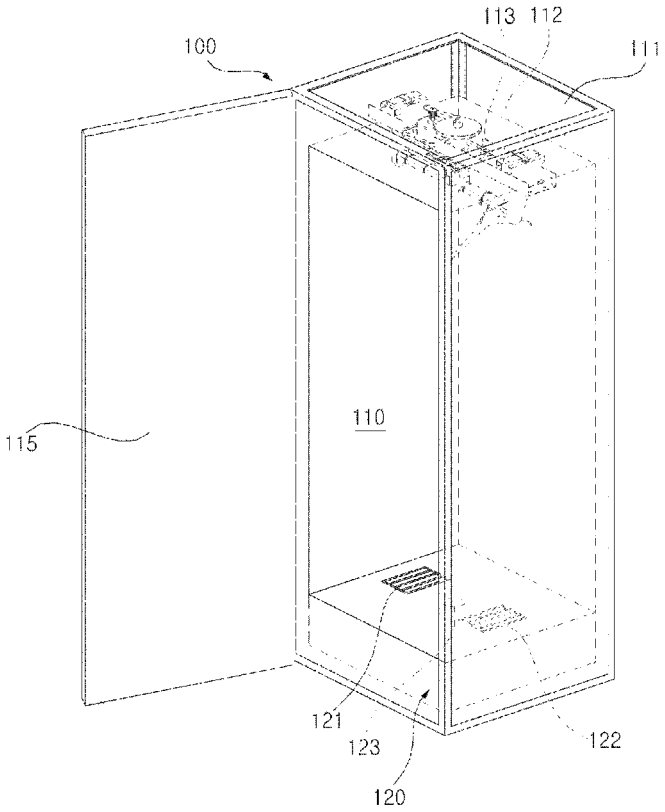
FIG. 1 is a perspective view illustrating a laundry treating apparatus according to an exemplary embodiment of the present invention.
Figure 2:
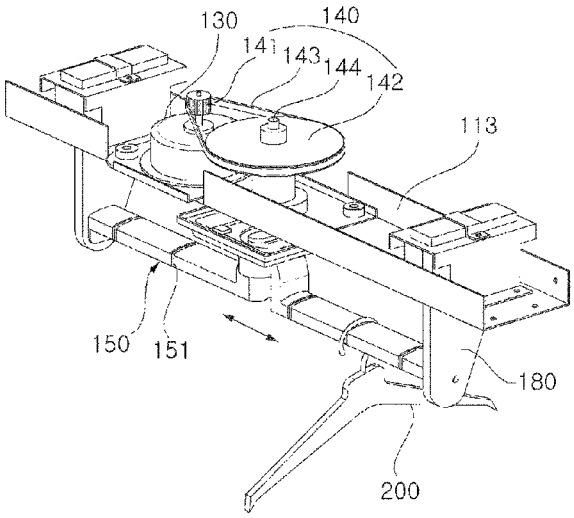
FIG. 2 is a perspective view partially illustrating key parts of the laundry treating apparatus shown in FIG. 1.
Figure 3:
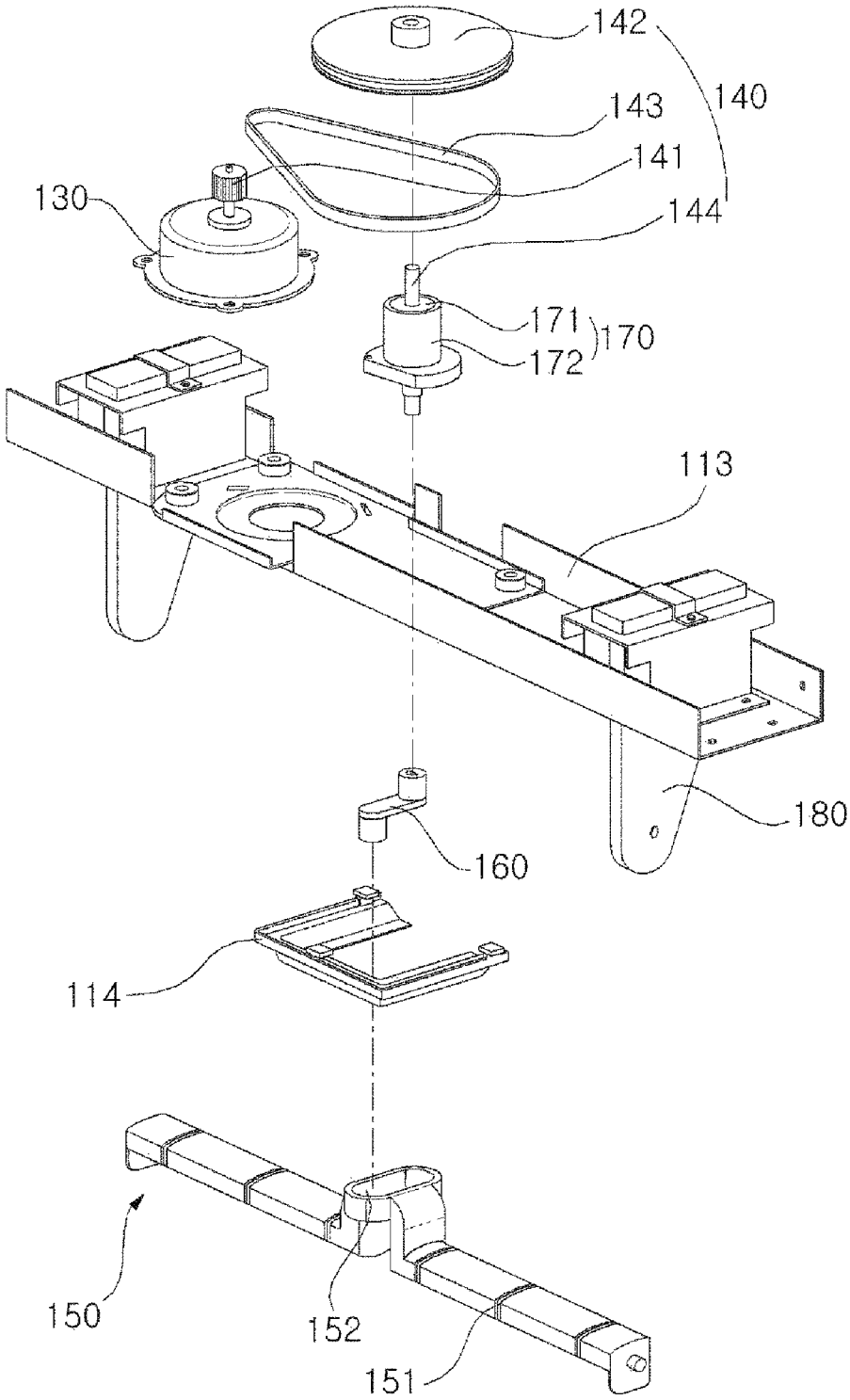
FIG. 3 is an exploded perspective view illustrating the key parts shown in FIG. 2.
Figure 4:
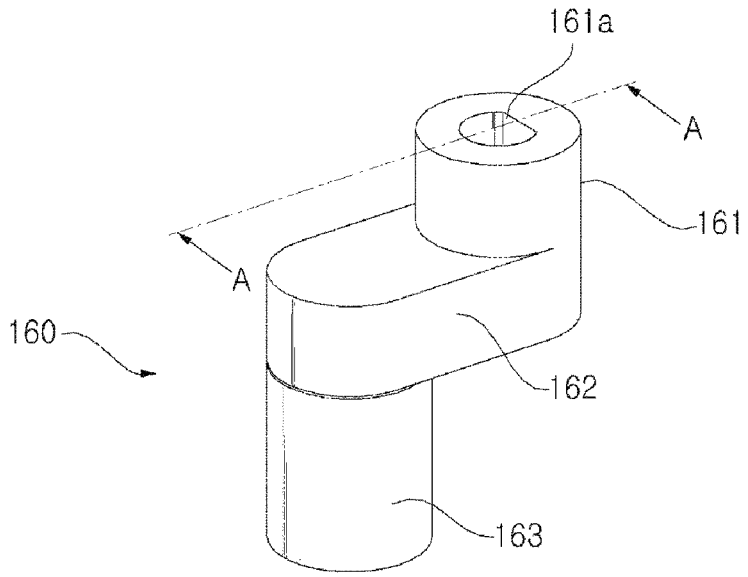
FIG. 4 is a perspective view illustrating a power converting part shown in FIG. 3.

FIG. 1 is a perspective view illustrating a laundry treating apparatus 100 according to an exemplary embodiment of the present invention. FIG. 2 is a perspective view partially illustrating key parts of the laundry treating apparatus shown in FIG. 1. FIG. 3 is an exploded perspective view illustrating the key parts shown in FIG. 2. FIG. 4 is a perspective view illustrating a power converting part 160 shown in FIG. 3. The laundry treating apparatus will be described in reference to FIGS. 1 to 4.

The laundry treating apparatus 100 includes an outer cabinet 111 defining an external appearance thereof and an inner cabinet 112 provided in the external cabinet 110. The inner cabinet 112 defines a treating chamber 110 formed therein.

The treating chamber 110 includes an opening formed in one side thereof to load and unload laundry there through. The opening is opened and closed by a door 15. Once the door 115 is closed, the treating chamber 110 is shut off from the outside and once the door 115 is opened, the treating chamber 110 is exposed to the outside.

Hot air or steam is applied to the laundry in the treating chamber 110 to treat laundry physically or chemically. That is, the treating chamber is the space in which the laundry is treated in various methods, for example, hot air is supplied to dry the laundry or steam is supplied to remove wrinkles or aromatic material is sprayed to treat the laundry having a pleasant fragrance or anti-static material is sprayed to prevent the laundry from being static.

The laundry treating apparatus 100 further includes a heating part 120, a hanger bar 150, a driving part 130, a power transmitting part 140 and a power converting part 160. The heating part 120 supplies at least one of the hot air and steam to the treating chamber 100. The hanger bar 150 is arranged in the treating chamber 110. The driving part 130 is mounted on the treating chamber 110 and it generates a rotational force and the power transmitting part 140 transmits the rotational force of the driving part 130. The power converting part 160 converts the rotational force transmitted by the driving part 130 to reciprocate the hanger bar 150.

The heating part 120 is mounted below the treating chamber 110, more specifically, in a predetermined space between the outer cabinet 111 and the inner cabinet 112. The heating part 120 sucks air inside the treating chamber 110 to heat and then it ventilates the heated air into the treating chamber 110, or the heating part 120 generates steam by heating water and exhaust the generated steam into the treating chamber 110. Here, the heating part 120 may be configured to supply both the heated air and steam together or to supply the heated air or steam selectively. The heating part 120 may be embodied variously to supply hot air and/or steam by those who are skilled in the art.

In the meanwhile, the heating part may include a hot wire that is an electrical resistant or a heat pump to supply the hot air to the treating chamber. In case of supplying the hot air to the treating chamber by using the heat pump, energy consumption will decrease and the drying can be performed by using a relatively low temperature heated air only to prevent fabric damage, in comparison to the case of supply the hot air by using the hot wire. In addition, the hot air supply by using the hot wire requires quite often temperature control to prevent fabric damage. However, the hot air supply by using the heat pump enables simple temperature control advantageously, in comparison to the former case.

According to this embodiment, the heating part 120 includes an air inlet 121 to suck air inside the treating chamber 110, a heater (not shown) heating the sucked air, a hot air outlet 122 to discharge the air heated by the heater into the treating chamber 110 and a steam outlet 123 to spray steam into the treating chamber 110.

The hot air and/or steam generated by the heating part 120 is applied to the laundry loaded into the treating chamber 110 only to affect the physical or chemical property of the laundry. That is, the fabric texture of the laundry is loosened by the hot air or steam generated by the heating part 120 such that the wrinkles of the laundry may be removed and particles of the unpleasant smell react to the steam such that the unpleasant smell may be removed. In addition, the hot air and/or steam generated by the heating part 120 may sterilize bacteria parasitic on the laundry effectively.

The driving part 130 may be arranged in the space between the inner cabinet 112 and the outer cabinet 111 to be located on an outside of the treating chamber 110. The driving part 130 may be embodied as motor that can generate a rotational force. The driving part 130 may be seated in a driving part frame 113 fixed between the inner cabinet 112 and the outer cabinet 111. The driving part frame 113 is employed to dampen vibration generated during the operation of the driving part 130 as well as to secure the driving part 130 therein.

As the driving part 130 is located on an outside of the treating chamber 110, inner space of the treating chamber 110 may be secured sufficiently enough to treat a large amount of laundry. Also, in case the driving part 130 is located in a side portion of the treating chamber 110, the overall width of the laundry may be increased. However, as the driving part 130 is located on an outside of the treating chamber 110, the laundry treating apparatus according to the present invention may have an overall slim appearance. Since it is embodied slim, the laundry treating apparatus 100 may be installable in a relatively small space, for example, indoor and the like. Also, since the driving part 130 is installed in the upper space outside the treating chamber 110, the internal space of the treating chamber 110 may be enlarged as much as possible to increase the amount of the treatable laundry advantageously.

The power transmitting part 140 transmits the rotational force generated by the driving part 130 to the power converting part 160. The power transmitting part 140 transmits the rotational force and it may be embodied in various types by those skilled in the art.

The power transmitting part 140 includes a driving pulley 141 rotated by the driving part 130, a driven pulley 142 connected with the driving pulley 141 by a belt 143 to rotate together with the driving pulley and a shaft secured to the driven pulley 142 to rotate.

According to this embodiment, a diameter of the driven pulley 142 is larger than a diameter of the driving pulley 141. As the rotational force is transmitted to the driving pulley 141 by the driving part 130 directly, the driving pulley 141 is rotated at a relatively high rotation number. If the hanger bar 150 is reciprocated at the same interval as that of the rotation generated by the driving part 130, too much vibration would be generated and overload is applied to the driving part 130 such that treating efficiency of the laundry placed on the hanger bar 150 may deteriorate. As a result, the diameter of the driven pulley 142 is larger than that of the driving pulley 141 and it is preferable that a ratio of the diameter of the driving pulley 141 to that of the driven pulley 142 is 1:5~1:15.

The power transmitting part 140 may be configured of diverse elements, for example, a driving sprocket, a driven sprocket and a chain or alternatively configured of a driving gear, a driven gear and a belt having gear teeth formed therein, instead of the driving pulley 141, the driven pulley 142 and the belt 143.

The laundry treating apparatus 100 may further include a bearing part 170 fit about the shaft 144 externally. The bearing part 170 includes a bearing housing 172 and a first bearing 171 provided between the shaft 144 and an inner surface of the hearing housing 172. The bearing part 170 is fixed to the driving part frame 113, supporting the shaft 144, and it enables the shaft 144 to rotate smoothly. The first bearing 171 may be an oilless bearing not to contaminate the laundry received in the treating chamber 110.

The power converting part 160 converts the rotational movement transmitted by the power transmitting part 140 to reciprocate the hanger bar 150. The power converting part 160 includes a shaft connected portion 161 connected to the shaft 144 of the power transmitting part 140, a rotation arm 162 extended from the shaft connected portion 161 and a slot connected portion 163 extended from an end of the rotation arm 162 to be inserted in a slot 152 of the hanger bar 150 and rotatable with respect to the shaft 144.

The shaft connected portion 161 is formed in an end of the power converting part 160 and an inserting hole 161*a* is formed in the shaft connected portion 161 to insert the shaft 144 therein. The rotation arm 162 may be extended from the shaft connected portion 161 approximately perpendicularly to the shaft. The slot connected portion 163 is extended downward from the end of the rotation arm 162. Once the shaft 144 is rotated, the slot connected portion 163 is rotated from the shaft 144, with a predetermined radius. If the rotation arm 162 is formed orthogonally with respect to the shaft 144, the predetermined radius may be corresponding to the length of the rotation arm 162. The detailed structure of the slot connected portion will be described later.

The hanger bar 150 includes a hooking groove 151 to hook a hanger 200 therein and a slot 152 formed in a center thereof and it is reciprocated with being hung on a top of the treating chamber 110. Both opposite sides of the hanger bar 150 may be connected to the inner cabinet 112 defining a top of the treating chamber 110 by the supporters 180 or to the driving part frame 113.

The slot 152 may be formed longitudinally in an orthogonal direction with respect to the movement of the hanger bar 150. Hereinafter, if the direction of the reciprocating movement of the hanger bar 150 is referenced to as a rightward/leftward direction in the treating chamber, the slot 152 may be formed longitudinally in a forward/rearward direction. As the slot 152 is longitudinal in the forward/rearward direction, the slot connected portion 163 is rotated about the shaft and then the forward/rearward movement is dampened by the slot 152 such that the hanger bar 150 may reciprocate rightward and leftward.

Figure 13:
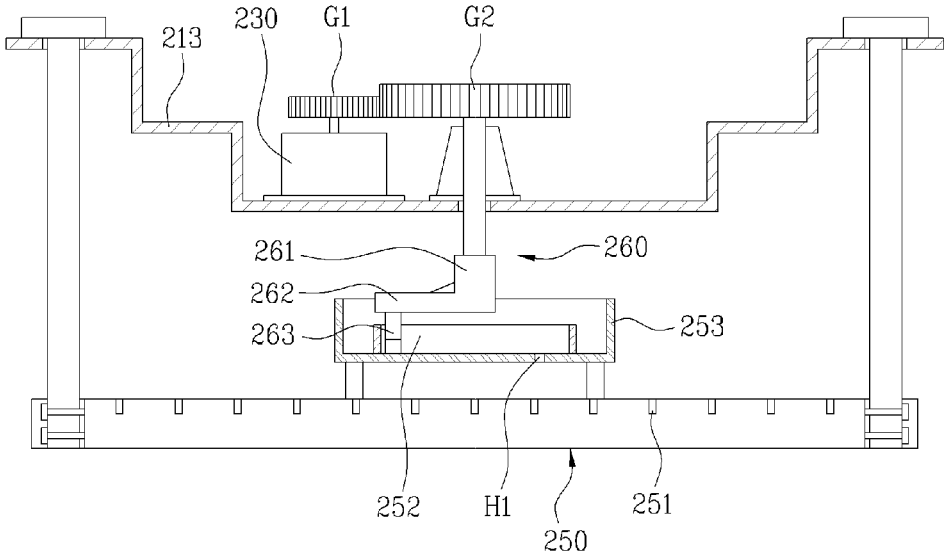
FIG. 13 is a conceptual view illustrating a moving hanger according to a further embodiment.

Water condensed from moisture contained in the damp air inside the treating chamber 110 would be stored in the slot 152. As a result, a drain hole (FIG. 13, H1) may be formed in the slot 152 to drain the stored water outside.

The supporter 180 includes a flexible material to allow the hanger bar 150 to reciprocate smoothly. Especially, the supporter 180 may be formed of a plate that is long in the forward/rearward direction to limit the forward/rearward movement of the hanger bar 150 and an end of the supporter 180 may be fixed to the inner cabinet 112 and the other end thereof may be fastened to the hanger bar 150.

A cover 114 may be arranged between the inner cabinet 112 and the hanger bar 150 to cover the power converting part 160. When the treating chamber 110 is open, the structure including the power converting part 160 is not visible to the user such that an effect of improved aesthetic and luxurious appearance may be generated.

The cover 114 may be formed of a separate part from the hanger bar 150 according to this embodiment and it may be integrally formed with the slot 152 of the hanger bar 150.

Figure 5:
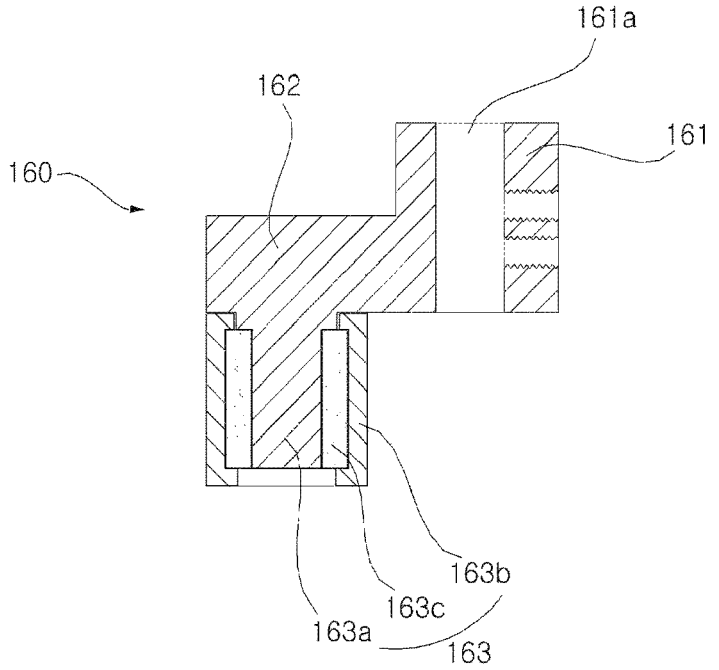
FIG. 5 is a sectional view illustrating the power converter cut away along A-A line.

FIG. 5 is a sectional view illustrating the power converting part 160 shown in FIG. 4, cut away along A-A line. In reference to FIG. 5, the power converting part 160 includes a protrusion 163*a* formed in the rotation arm 162, a suspending member 163*b* circumscribed by the protrusion 163 and a second bearing 163*c* provided between the protrusion 163*a* and the suspending member 163*b*.

The suspending member 163*b* removes shocking noise generated between the power converting part 160 and an inner surface of the slot 152. An outer surface of the suspending member 163*b* is spaced apart a predetermined distance from an inner surface of the slot to allow the power converting part 160 to move smoothly in the state of being inserted in the slot 152. The suspending member 163*b* is made of flexible material having a predetermined elasticity, for example, rubber and it contacts with the inner surface of the slot 152 flexibly when the hanger bar 150 is reciprocated, such that the distance may be formed between the power converting part 160 and the slot 152 to enable the laundry tack 150 reciprocated smoothly.

The suspending member 163*b* may be coated with PTFE (Poly Tetra Fluoro Ethylene) to reduce friction generated with the inner surface of the slot 152. PTFE has good self-lubrication and good abrasion-resistance in case of frictional movement.

The second bearing 163*c* may be an oilless bearing not to contaminate the laundry received in the treating chamber 110.

As follows, another embodiment of the present invention will be described.

Figure 6:
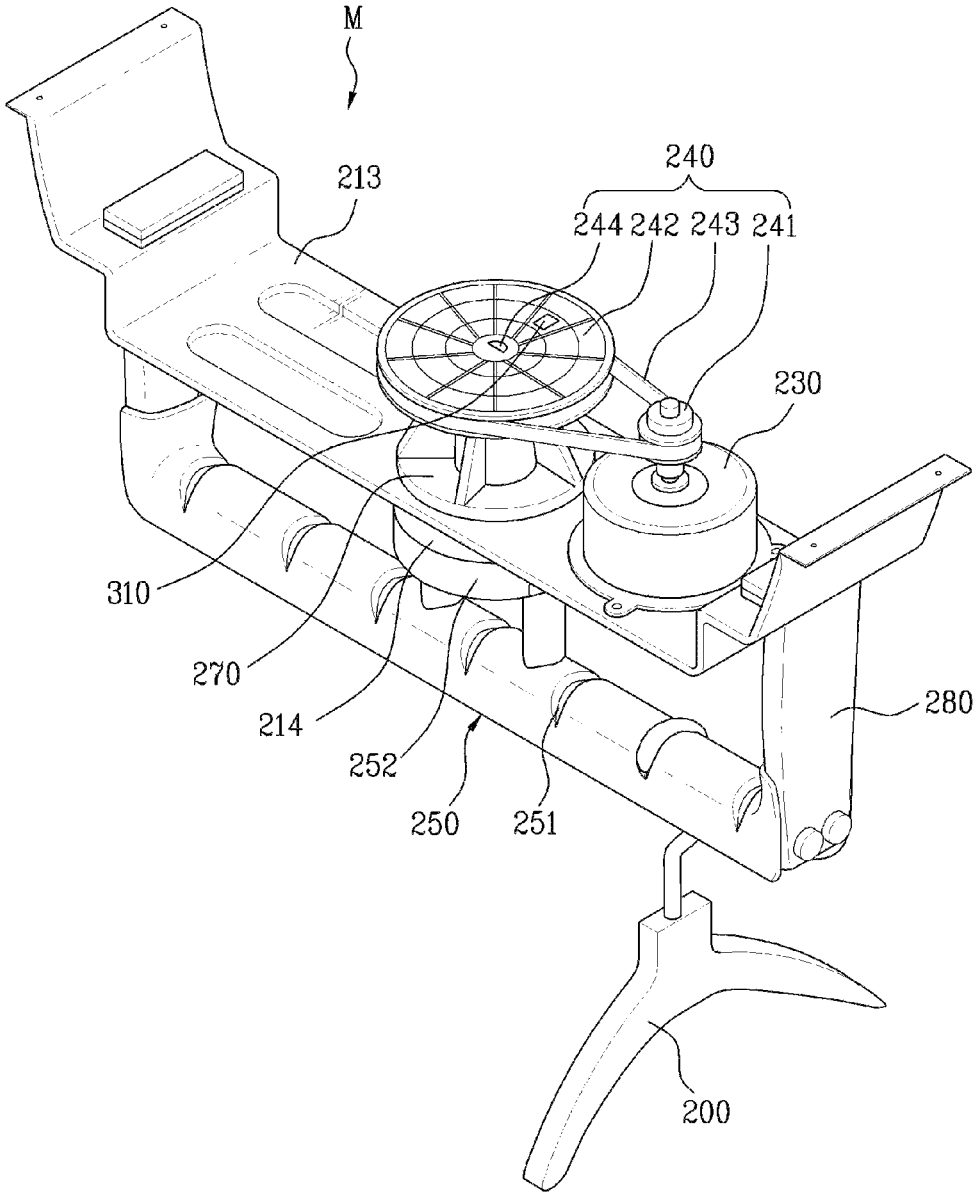
FIG. 6 is a perspective view illustrating a moving hanger according to another embodiment of the present invention.
Figure 7:
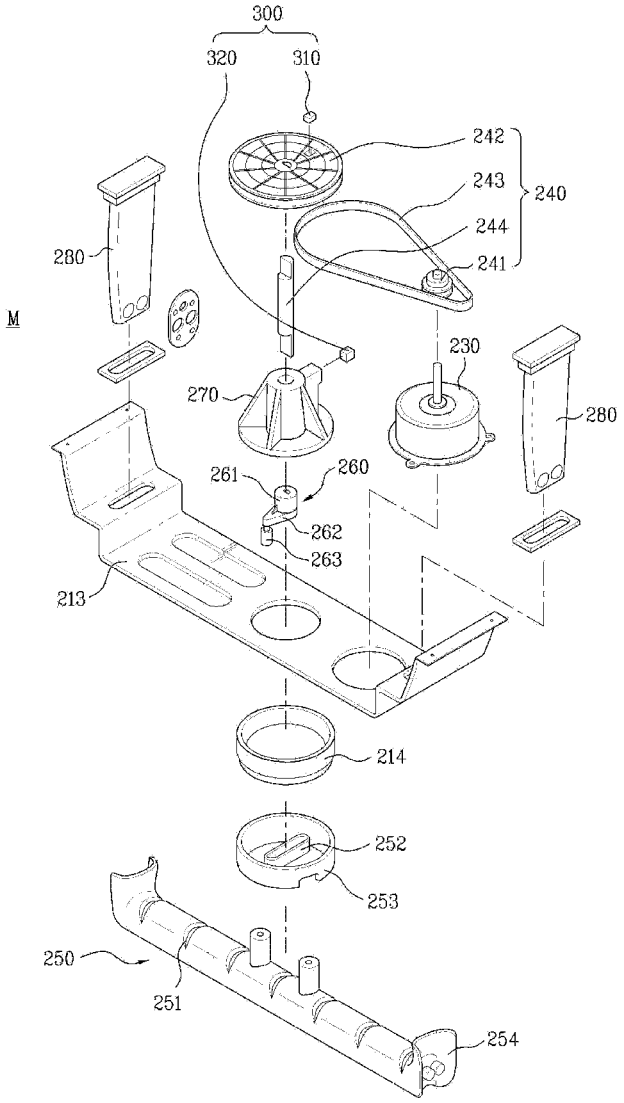
FIG. 7 is an exploded perspective view illustrating the moving hanger shown in FIG. 6.

FIG. 6 is a perspective view illustrating a moving hanger (M) according to this embodiment and FIG. 7 is an exploded perspective view of FIG. 6. A shape of a slot 252 is diversified to diversify the movement of the hanger bar and a sensing part 300 capable of determining the position of the hanger bar is provided in the moving hanger (M) shown in FIGS. 6 and 7 according to this embodiment, different from the moving hanger shown in FIGS. 2 and 3.

Moreover, according to the moving hanger (M) of this embodiment, a slot housing 253 in which the slot 252 is provided and the hanger bar 250 are separately independent from each other, which is different from the moving hanger shown in FIG. 3. The slot shown in FIG. 3 is integrally provided in the upper portion of the hanger bar. However, the slot 252 according to this embodiment may be provided in the slot housing 253 separately provided from the hanger bar 250. In this case, a cover 214 covering the structure including the power converting part 160 not to be exposed outside may be provided on the slot housing 253.

Both opposite ends of the hanger bar may include supporter accommodating ribs 254 surrounding the supporters 280, respectively. The supporter accommodating ribs 254 are provided to surround the ends of the supporters 280 only to minimize the exposure of the supporters 280 such that aesthetic appearance may be provided with the user and that the fastening between the hanger bar 250 and the supporters 280 may be secured.

Figure 8:
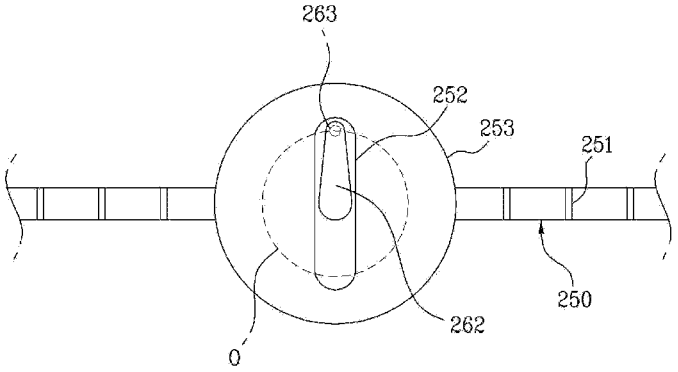
FIG. 8 is a top view illustrating a hanger bar.
Figure 9:
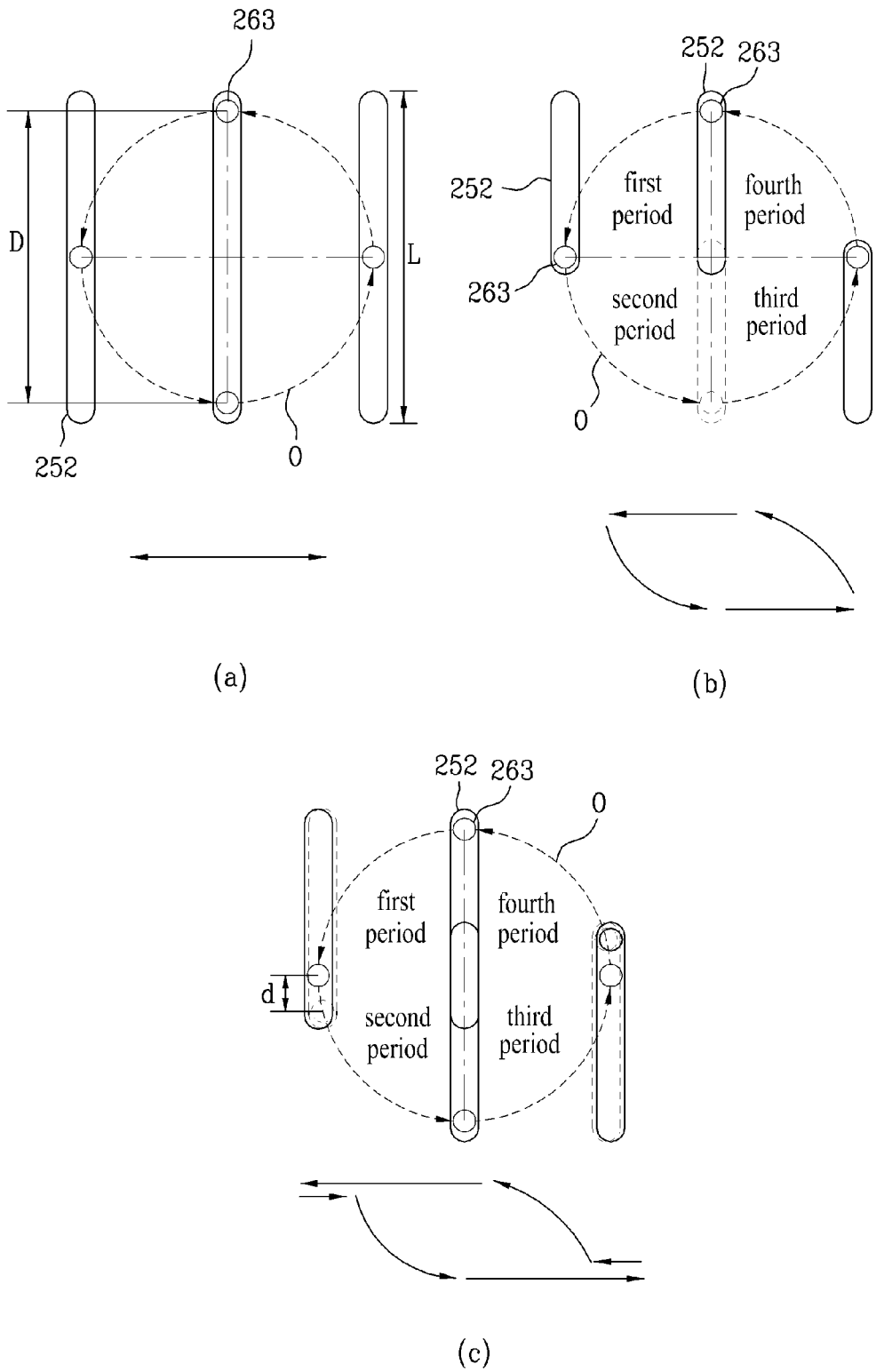
FIG. 9 is a diagram illustrating movement of the hanger bar according to the length of a slot.

FIG. 8 is a top side view of the hanger bar and FIG. 9 is a diagram illustrating the movement of the hanger bar according to the length of the slot.

In reference to FIG. 8, a slot connected portion 263 of the power converting part 260 has a rotational locus (O) shown as a dotted line because of the rotational force supplied by the driving part 230 and the slot 252 is moved along the movement of the slot connected portion 263. As a result, the movement of the hanger bar 250 fastened to the slot housing 253 may be determined by the movement of the slot 252.

Figure 10:
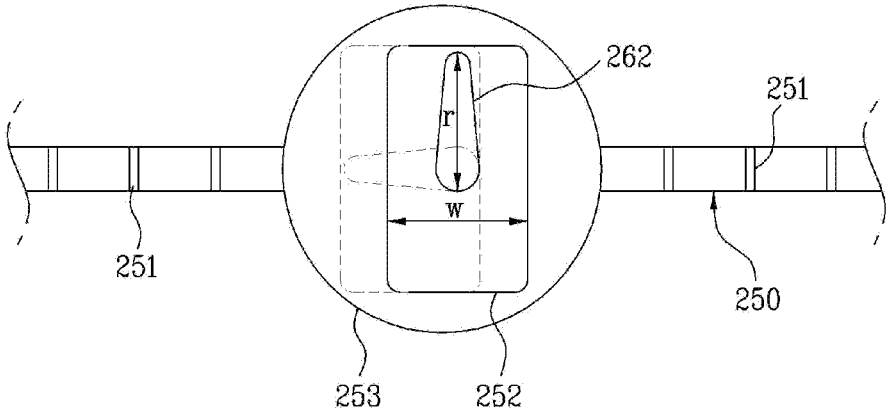
FIG. 10 is a diagram illustrating a rotation arm inserted in a slot.

FIG. 9A shows that the length (L) of the slot 252 is larger than the diameter of the rotation locus of the slot connected portion 263. FIG. 10 shows that the length of the slot 252 is larger than the radius and smaller than the diameter of the rotation locus of the slot connected portion 263.

If the length of the slot 252 is larger than the diameter of the rotation locus of the slot connected portion 263 as shown in FIG. 9A, the hanger bar 250 performs translational motion in a rightward/leftward direction seen in FIG. 9A. Here, the slot 252 may be formed perpendicular to or formed parallel to the longitudinal direction of the hanger bar 250.

That is, if the slot 252 is formed perpendicular to the longitudinal direction of the hanger bar 250 as sown in FIG.

9A, the hanger bar 250 performs the translational motion along its longitudinal direction. If the slot 252 is formed parallel to the longitudinal direction of the hanger bar 250, the hanger bar 250 may perform translational motion along a perpendicular direction with respect to its longitudinal direction.

More specifically, once the rotational force supplied by the driving part 230 rotates the shaft 244 via the driving pulley 241, the driven pulley 242 and the belt 243, the rotation arm 262 is rotated by the shaft connected portion 261 connected to the shaft 244. As a result, the slot connected portion 263 extended perpendicularly to the rotation arm 262 may have the rotation locus (O) shown in FIG. 9A.

At this time, a horizontal component of the slot connected portion motion pushes an outer circumferential surface of the slot 252 such that the slot 252 may be movable in the rightward/leftward direction. However, a vertical component of the slot connected portion 263 moves the slot connected portion 263 along the longitudinal direction of the slot 252 and it cannot move the slot 252 along the upward/downward direction because the slot 252 is longer than the diameter of the rotation locus of the slot connected portion.

As a result, if the slot 252 is perpendicular to the longitudinal direction of the hanger bar 250, the hanger bar 250 performs the translational motion in the parallel direction with respect to its longitudinal direction. If the slot 252 is in parallel to the longitudinal direction of the hanger bar 250, the hanger bar 250 performs the translational motion in the perpendicular direction with respect to its longitudinal direction.

If the length of the slot 252 is identical to the radius of the rotation locus (O) of the slot connected portion 263, the hanger bar 250 performs approximately oval-shaped motion as shown in FIG. 9B.

That is, the horizontal component of the motion of the slot connected portion 263 pushes the slot 252 in the leftward direction and the vertical component cannot move the slot 252 in the downward direction, during the first period in which the slot connected portion 263 is rotated to 90 degrees. The slot connected portion 263 having reached the location where the first period finishes is in contact with the slot 252 and in this state the rotation locus of the slot 252 will be equal to the rotation locus of the slot connected portion 263.

In the meanwhile, the slot 252 moves rightward as seen in the drawing during the third period like the first period and it moves during the fourth period like the second period, drawing the same locus as the locus of the slot connected portion 263.

As follows, in reference to FIG. 9C, the motion of the hanger bar 250 in case the length of the slot 252 is larger than the radius of rotation locus of the slot connected portion 263 and smaller than the diameter of rotation locus of the slot connected portion 263. In case the slot 252 is longer than the radius and shorter than the diameter of the rotation locus (O) of the slot connected portion 263, the hanger bar 250 performs predetermined motion combined with the translational motion and the oval motion.

Specifically, while the slot connected portion 263 is rotated in the first period, the horizontal component of the motion of the slot connected portion 263 moves the slot 252 leftward as seen in the drawing and the vertical component cannot move the slot downward as seen in the drawing.

As the length of the slot 252 is larger than the radius of the rotation locus of the slot connected portion 263, the slot connected portion 263 is spaced apart a predetermined distance (d) from the slot 252, not in contact with it even when the first period finishes. As a result, even when the slot connected portion 263 is rotated along the second period, the slot connected portion 263 performs the translational motion only in the rightward direction until to contact with the slot 252. Only when the slot connected portion 263 contacts with the slot 252, the slot 252 moves along the same locus as the rotation locus of the slot connected portion 263 and then the slot 252 performs the motion combined with the linear motion and circular motion.

The motion of the slot 252 in the third and fourth periods is identical to the motion of the slot 252 in the first and second periods, except the direction of the motion, and the detailed description thereof will be omitted accordingly.

The reason why the hanger bar 250 embodies the above motion is that the drying and removing of unpleasant smell and wrinkles functions can be improved. That is, the when the hot air or steam is supplied to the treating chamber 110 via the hot air outlet 122 or steam output 123, the hanger bar may shake the laundry to make the laundry contact with the hot air or steam efficiently. As a result, the functions of drying and deodorizing/wrinkle-removing may be improved.

FIG. 10 is a diagram illustrating the rotation arm inserted in the slot.

That is, according to the above embodiment, the power converting part 260 includes the slot connected portion 263 to be inserted in the slot 252. Alternatively, according to this embodiment of FIG. 10, the rotation arm 262 is inserted in the slot 252.

In this case, the slot 252 should have a predetermined space to allow the rotation arm 262 to rotate along the shaft 244. The width (W) of the slot 252 is equal to or larger than the radius (r) of the rotation locus of the rotation arm 262.

Figure 11:
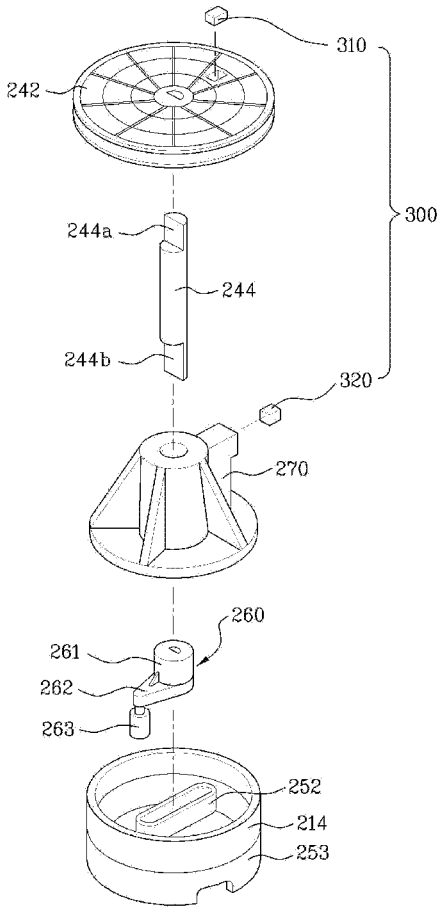
FIG. 11 is an enlarged perspective view illustrating a driven pulley, a shaft and the power converting part.

FIG. 11 is an enlarged perspective view illustrating the driven pulley, shaft and power converting part.

As follows, in reference to FIG. 11, the moving hanger including the sensing part to sense the location of the hanger bar 250 will be described.

The sensing part 300 includes a magnetic substance 310 provided in the driven pulley 242 and a magnetic force sensor provided in the bearing housing 270 supporting the shaft, being connected to a control part (not shown).

During the operation of the laundry treating apparatus, the hanger bar 250 shakes the laundry by using the power supplied by the driving part 230, the power converting part 260 and the slot 252.

If the hanger bar 250 maintains to be located in a sided portion of the treating chamber 110 when the operation of the laundry treating apparatus finishes, overload is applied to the supporters supporting the hanger bar 250 and the user feel unsatisfied when opening the door.

As a result, a center portion which is an example, not limited thereto, is preset as an initial position of the hanger bar 250. When the heating part 120 finishes operation, the hanger bar 250 is moved to its initial position and then the operation of the laundry treating apparatus finishes completely, to solve the above problem.

According to this embodiment, the magnetic substance 310 is provided in the driven pulley 242 and the magnetic force sensor 320 is provided in the bearing housing 270 and the present invention may not exclude a case of vice versa. Here, the bearing housing 270 in which the magnetic force sensor 320 is provided is selected because it is adjacent to the driven pulley. The position of the magnetic force sensor may be diverse as long as it can sense the magnetic force of the magnetic substance 310.

In case the center portion of the treating chamber 110 is preset to be the initial position of the hanger bar 250, an assembler of the moving hanger (M) determines whether the hanger bar 250 is located in the center portion of the treating chamber and after the determination he/she locates the magnetic substance 310 in the driven pulley 242 and he/she secures the magnetic force sensor 320 to the bearing housing 270. Because of that, much time and work are required to install the sensing part 300 disadvantageously.

As follows, in case the center portion of the treating chamber 110 is preset to be the initial position of the hanger bar 250, the moving hanger capable of determining whether the hanger bar 250 is located in the initial position, having a simple assembly process, will be described.

If both ends of the hanger bar 250 are spaced apart identical distances from the inner circumferential surface of the treating chamber 110, respectively, the slot housing 253 may be provided to locate the slot 252 in a center portion of the hanger bar 250 along a longitudinal direction of the hanger bar 250. Upper position determining part and lower position determining part are provided in upper and lower ends of the shaft 244, respectively.

The upper position determining part may be a cut-away surface provided in an upper end portion of the shaft (hereinafter, an upper end cut-away surface 244*a*) and the driven pulley 242 may be fastened to the upper end of the shaft via the upper-end-cut-away surface 244*a*.

As a result, once the driven pulley 242 is fastened to the upper-end-cut-away surface 244*a*, the position of the magnetic substance 310 may be determined uniformly such that the magnetic substance 310 may be assembled with the magnetic force sensor 320 more smoothly.

The lower end position determined part may be a cut-away surface provided in an lower end of the shaft (hereinafter, a lower-end-cut-away surface 244*b*) the power converting part 260 may be fastened to the lower end of the shaft via the lower-end-cut-away surface 244*b*.

Here, when the driven pulley 242 is fastened to the upper-end-cut-away surface 244*a*, the lower-end-cut-away surface may enable the slot connected portion 263 of the power converting part 260 to be inserted in the slot 252.

As a result, only if the driven pulley 242 and the power converting part 260 are assembled with the upper-end-cut-away surface and the lower-end-cut-away surface of the shaft 244, respectively, the magnetic force sensor 320 may face the magnetic substance 310 to sense and the slot connected portion 263 of the power converting part 260 may be located in the slot 252 and also the slot 252 may be located in the center of the hanger bar 250 in the longitudinal direction.

That is, the initial position of the hanger bar 250 may be preset, without the assembly worker's additional identification of the initial position when assembling the moving hanger (M).

According to the moving hanger (M) described in the above embodiment, the power of the driving part is transmitted to the hanger bar via the driven pulley, the driving pulley, the belt and the power converting part. The present invention may not exclude a case of transmitting the power of the driving part to the shaft via a driving gear (FIG. 13, G1) and a driven gear (FIG. 13, G2) and a case of directly transmitting the power of the driving part to the hanger bar.

In case the driving gear G1 and the driven gear G2 are provided, the driving gear G1 having gear teeth is secured to the driving part and the driven gear G2 is engaged with the gear teeth of the driving gear G1. Then, the power of the driving part can be transmitted to the shaft not through the belt such that more precise power transmission may be enabled.

Figure 12:
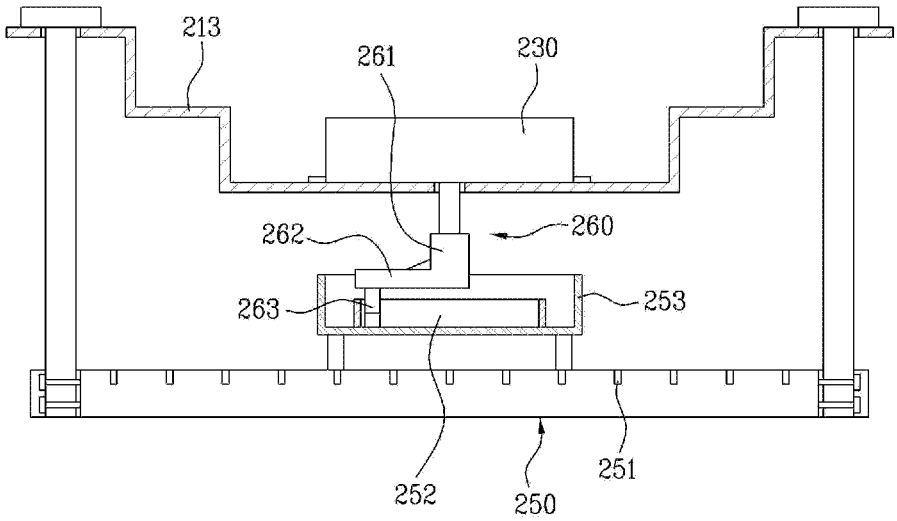
FIG. 12 is a conceptual view illustrating a moving hanger according to a further embodiment.

In case the power of the driving part is directly transmitted to the hanger bar, the shaft connected portion 261 of the power converting part 260 is directly connected to the shaft of the driving part 260 and then the power of the driving part 230 is directly transmitted to the hanger bar 250 such that the hanger bar 250 may be controlled more efficiently than the indirect transmission methods using the driving pulley, the driven pulley and the belt (FIG. 12).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating apparatus comprising:
- a treating chamber;
- a heating part to supply at least one of hot air or steam to the treating chamber;
- a hanger bar in the treating chamber, the hanger bar including a slot;
- a driving part on an outside of the treating chamber to generate a rotational force; and
- a power converting part to move the hanger bar by converting the rotational force transmitted by the driving part, wherein the power converting part comprises:
- a shaft connected portion connected to a shaft of the driving part;
- a rotation arm extended from the shaft connected portion in an orthogonal direction with respect to the shaft; and
- a slot connected portion, rotatable with respect to the shaft, projected from an end of the rotation arm and in the slot of the hanger bar, and wherein a length of the slot is greater than or equal to a radius of a rotational locus formed by the slot connected portion and less than a diameter of a rotational locus formed by the slot connected portion.

2. The laundry treating apparatus as claimed in claim 1, wherein the slot is orthogonal to a longitudinal direction of the hanger bar.

3. The laundry treating apparatus as claimed in claim 1, wherein the slot is parallel with a longitudinal direction of the hanger bar.

4. A laundry treating apparatus comprising:
- a treating chamber to accommodate laundry;
- a heating part to supply at least one of hot air and steam to the treating chamber;
- a hanger bar in the treating chamber, the hanger bar having a slot;
- a driving part on an outside of the treating chamber to generate a rotational force;
- a power transmitting part transmitting the rotational force of the driving part; and
- a power converting part converting the rotational force transmitted by the power transmitting part to reciprocate the hanger bar, wherein the power transmitting part comprises:
- a driving pulley rotated by the driving part;
- a driven pulley in communication with the driving pulley;
- a belt connecting the driving pulley with the driven pulley; and
- a shaft rotated by the driven pulley, wherein the power converting part comprises:
- a shaft connected portion connected to the shaft;
- a rotation arm extended from the shaft connected portion in an orthogonal direction with respect to the shaft; and
- a slot connected portion projected from an end of the rotation arm and in a slot of the hanger bar, and wherein a length of the slot is greater than or equal to a radius of a rotational locus formed by the slot connected portion and less than a diameter of a rotational locus formed by the slot connected portion.

5. The laundry treating apparatus as claimed in claim 1, further comprising a bearing part having a first bearing to support the shaft.

6. The laundry treating apparatus as claimed in claim 1, wherein a diameter of the driven pulley is larger than a diameter of the driving pulley.

7. The laundry treating apparatus as claimed in claim 1, wherein the slot comprises a drain hole.

8. The laundry treating apparatus as claimed in claim 1, wherein the slot is oriented in an orthogonal direction with respect to a motion of the hanger bar.

9. The laundry treating apparatus as claimed in claim 5, wherein the slot connected portion comprises:

a protrusion from the rotation arm; and a suspending member circumscribed by the protrusion.

10. The laundry treating apparatus as claimed in claim 9, wherein the suspending member includes a flexible material.

11. The laundry treating apparatus as claimed in claim 9, wherein the slot connected portion comprises a second bearing between the protrusion and the suspending member.

12. The laundry treating apparatus as claimed in claim 11, wherein the second bearing is an oilless bearing.

13. The laundry treating apparatus as claimed in claim 1, further comprising:

a supporter supporting the hanger bar, the supporter comprising a flexible member.

14. The laundry treating apparatus as claimed in claim 13, wherein the supporter limits a forward/rearward motion of the hanger bar.

15. The laundry treating apparatus as claimed in claim 1, wherein the slot is orthogonal to a longitudinal direction of the hanger bar.

16. The laundry treating apparatus as claimed claim 1, wherein the slot is parallel with a longitudinal direction of the hanger bar.

17. The laundry treating apparatus as claimed in claim 1, further comprising:

a sensing part sensing a position of the hanger bar.

18. The laundry treating apparatus as claimed in claim 17, further comprising a control part receiving a signal from the sensing part, wherein the control part moves the hanger bar to a predetermined initial position after an operation of the heating part is completed.

19. The laundry treating apparatus as claimed in claim 17, wherein the sensing part comprises:

a magnetic substance; and a magnetic force sensor capable of sensing a magnetic force of the magnetic substance.

20. The laundry treating apparatus as claimed in claim 19, further comprising a bearing housing supporting the shaft, wherein one of the driven pulley and the bearing housing includes the magnetic substance, and the other of the driven pulley and the bearing housing includes the magnetic force sensor.

21. The laundry treating apparatus as claimed in claim 20, wherein an upper position determining part is in an outer circumferential surface of an upper end of the shaft in which the magnetic force sensor is able to sense the magnetic substance if the driven pulley is fastened to the shaft, and wherein a lower position determining part is in a lower circumferential surface of a lower end of the shaft in which the slot connected portion is able to be inserted in the slot if the driven pulley is fastened to the upper position determining part.

22. The laundry treating apparatus as claimed in claim 21, wherein the upper position determining part and the lower position determining part are cut-away surfaces in the outer circumferential surface of the shaft.

23. A laundry treating apparatus comprising:

a treating chamber;

a heating part to supply at least one of hot air or steam to the treating chamber;

a hanger bar in the treating chamber, the hanger bar having a slot;

a driving part on an outside of the treating chamber to generate a rotational force;

a power converting part to move the hanger bar by converting the rotational force transmitted by the driving part; and a power transmitting part transmitting the rotational force transmitted by the driving part to the power converting part, the power transmitting part comprising:

a driving gear rotated by the driving part;

a driven gear in communication with the driving gear; and a shaft rotated by the driven gear, wherein the power converting part comprises;

a shaft connected portion connected to the shaft;

a rotation arm extended from the shaft connected portion in an orthogonal direction with respect to the shaft; and a slot connected portion rotatable with respect to the shaft, projected from an end of the rotation arm, and in the slot of the hanger bar, and wherein a length of the slot is greater than or equal to a radius of a rotational locus formed by the slot connected portion and less than a diameter of a rotational locus formed by the slot connected portion.

* * * * *